US005738237A

United States Patent [19]

McEldowney

[11] Patent Number: 5,738,237

[45] Date of Patent: Apr. 14, 1998

[54] EASY OPEN CONTAINER END, METHOD OF MANUFACTURE, AND TOOLING

[75] Inventor: Carl McEldowney, Russia, Ohio

[73] Assignee: Aluminum Company of America, Pittsburgh, Pa.

[21] Appl. No.: 476,406

[22] Filed: Jun. 7, 1995

[51] Int. Cl.[6] ..... B65D 17/34

[52] U.S. Cl. ..... 220/269; 413/16; 413/17

[58] Field of Search ..... 220/269, 271; 413/8, 12, 14, 15, 16, 17

[56] References Cited

U.S. PATENT DOCUMENTS

| | | | |
|---|---|---|---|
| 3,250,426 | 5/1966 | Fraze | 220/271 X |
| 3,485,410 | 12/1969 | Boik | 220/271 |
| 3,967,752 | 7/1976 | Cudzik | 220/269 |
| 4,015,744 | 4/1977 | Brown . | |
| 4,030,631 | 6/1977 | Brown . | |
| 4,361,251 | 11/1982 | Langseder et al. | 220/269 |
| 4,465,204 | 8/1984 | Kaminski et al. . | |
| 4,503,989 | 3/1985 | Brown et al. . | |
| 4,530,631 | 7/1985 | Kaminski et al. . | |
| 4,887,732 | 12/1989 | Matsubayashi et al. | 220/269 |
| 5,064,087 | 11/1991 | Koch | 220/269 |
| 5,375,729 | 12/1994 | Schubert . | |

FOREIGN PATENT DOCUMENTS

| | | | |
|---|---|---|---|
| 2553835 | 6/1976 | Germany | 220/269 |

*Primary Examiner*—Stephen Cronin
*Attorney, Agent, or Firm*—Thomas R. Trempus

[57] ABSTRACT

An easy open can end having an anti-missiling score integrally formed thereon, a method of further forming a can end to incorporate the anti-missiling score, and tooling for accomplishing the method.

18 Claims, 5 Drawing Sheets

EASY OPEN CONTAINER END, METHOD OF MANUFACTURE, AND TOOLING

BACKGROUND OF THE INVENTION

1. Field of the Invention

The present invention relates to easy-open ends for product containers, particularly, beverage and beer cans. In particular, the present invention provides an improved method for forming easy-open ends, improved tooling, and an improved can end that demonstrates superior anti-missile characteristics.

2. Prior Art

Many metallic cans for holding beverages or other products are provided with easy-open can ends, wherein a pull tab attached to a tear strip that is defined by a score in the can end. The pull tab may be lifted and then pulled to provide an opening in the can end for dispensing the can's contents. For ecological and safety reasons, many regions require that the tear strip and attached pull tab be retained to the can end after opening. In order to meet these requirements, various designs have been suggested by the prior art for ensuring that the tear strip and pull tab do not become separated from the can end. Generally, the pull tab is retained on the can end by means of a rivet. Methods of forming a can end can be found in U.S. Pat. Nos. 4,465,204 and 4,530,631 both to Kaminski et al., and assigned to the assignee of the instant invention. These patents are incorporated herein by reference as if fully set forth.

In the manufacture of an easy-open can end, a can end shell is first formed from a metal sheet product, preferably an aluminum sheet product. The can end shell is then transferred to a conversion press. In the typical operation of a conversion press, a can end shell is introduced between an upper tool member and a lower tool member which are in the open, spaced apart position. A press ram advances the upper tool member toward the lower tool member in order to perform any of a variety of tooling operations such as rivet forming, paneling, scoring, embossing, tab securing, and final staking. After performing a tooling operation, the press ram retracts until the upper tool member and lower tool member are once again in the open, spaced apart position. The partially converted shell is transported to the next successive tooling operation until an easy-open can end is completely formed and discharged from the press. As one shell leaves a given tooling operation, another shell is introduced to the vacated operation, thus continuously repeating the entire easy-open can end manufacturing process.

The sheet material from which can end shells are produced is provided with a special coating during manufacture. The coating serves several purposes including substantially if not completely eliminating the so-called "aluminum taste" that can be experienced in consuming a product contained in an aluminum container. is Such coatings are particularly resilient and are expected to withstand to an exceptionally satisfactory degree the extensive forming and reforming that occurs during the manufacture of a converted can end from an aluminum sheet product. Nonetheless, a converted can end may occasionally experience metal exposure caused by damage to the coating. Such damage may occur during the post manufacturing handling of the can ends. For example, upon the completion of the conversion process, the converted can ends are stacked or nested, one on top of another and packaged in a paper sleeve for transport to the can filling line where the can bodies are filled with a beverage product and the converted can ends attached to the filled can bodies. During the stacking or nesting process the top or consumer side of a first can end is in contact with the bottom, or beverage side, of an adjacent can end. Any rotational movement of the can ends relative to each other can result in damage to the coating on the beverage side of the can end. Can ends that include an extensive use of beads or the like that, for example, cause a portion or portions of the can end to be disposed below a reference defined generally by the planer, bottom panel portion of the tear away tab of the can end, often experience damage to the coating.

In certain canned products, such as carbonated beverages, there is substantial internal pressure that can be in the order of 90 to 100 psi or even perhaps greater, and must be quickly and safely vented during the initial opening of the can end by the consumer. According, can ends are constructed for venting or releasing the internal pressure of the container during the initial operation of the easy open mechanism of the end. The mechanism of venting is described in prior art patents such as U.S. Pat. Nos. 4,015,744 and 4,030,631, the contents of which are incorporated by reference herein as if fully set forth. As mentioned above briefly, the easy open mechanism includes an end panel which is attached to the can body or container, a tear panel defined in the end panel by a scoreline, an operating tab including a nose which extends partially over the tear panel, and an integral rivet connecting the tab to the end panel and defining a pivot point for tab operation. Basically, initial lifting of the tab produces an upward force on the rivet and a downward force on the edge of the tear panel adjacent a beginning point of the tear panel scoreline. This in turn causes an initial opening of the tear panel beneath the nose of the tab in an area referred to as the vent region of the can end. Further lifting motion of the tab causes the tear panel to separate progressively along its scoreline, leaving a small integral connection between the end panel and the tear panel, about which the tear panel is rotated inward of the container to form an opening through which container contents can be removed.

As mentioned above, there can be substantial internal gas pressure in the container. During the initial opening motion, this gas pressure must vent safely. It is the typical practice to define a small vent opening with a hook formation at the radially inward end of the scoreline. The vent opening or region extends to a score stop located in the region where the tear panel scoreline proceeds outward at the end. Typically, the score stop is in the form of a shallower segment of the scoreline of relatively short length as described in U.S. Pat. No. 4,503,989. The contents of this patent are incorporated herein by reference as if fully set forth. This score stop provides an increase in tear resistance along the scoreline.

U.S. Pat. No. 5,375,729 for an easy open container end teaches the use of an anti-missile structure formed by a beading operation. The formed bead is subsequently coined.

It is an object of this invention to provide a can end with an improved anti-missiling configuration.

It is yet another object of this invention to provide a can end with improved anti-missiling operation and configuration that does not require the presence of beading or similar coined bead structures that can have an adverse effect on the coating on the beverage side of the converted can end.

It is yet another object of this invention to provide a method for preventing missiling during the venting of a converted can end.

It is still another object of this invention to provide an improved set of tooling for the manufacture of converted can ends.

It is another object of this invention to provide a converted can end and a method for manufacturing the same.

SUMMARY OF THE INVENTION

The invention provides an easy open can end having an anti-missiling vent score integrally formed thereon, a method for further forming a can end, and tooling for carrying out the process and apparatus of the invention. In an easy open can end for a beer or beverage container, the can end has a tear panel defined by a fracture scoreline surrounding a portion of the periphery of said tear panel. The fracture scoreline defines a region where the tear panel is to be separated from the remainder of the end to define an opening through the end. The end includes an operating tab and an integral rivet attaching the tab to the end adjacent the fracture scoreline. The rivet is on the opposite side of the fracture scoreline from the tear panel. The fracture scoreline includes a vent region adjacent the rivet constructed and arranged to open initially at the vent region in response to the lifting of the rivet by the tab. During the lifting of the tab there is often an initial "pop" followed by some brief resistance. Once this resistance is overcome, the tear panel tends to separate from the panel with a generally uniform pressure. This final opening effort is often referred to in the industry as the "push" that follows the initial "pop" that occurs when the consumer opens an easy open can end.

According to the invention, an anti-missiling score is formed in the tear panel to one side of the rivet and adjacent an edge of the vent region of the scoreline. The anti-missile score has a length extending along at least a part of the vent region. Upon fracturing of the vent region, the anti-missile score will cause an edge of the tear panel to move temporarily underneath the end panel. This temporary disposition of the initially fractured portion of the tear panel serves to prevent the rapid disassociation of the tear panel from the end panel, or more simply, the "missiling" of the tear panel. Typically, the anti-missile score is a short straight score or it can be contoured to the shape of the fracture scoreline at the vent region. The fracture scoreline is of a first predetermined depth. The anti-missile scoreline is of the second predetermined depth that is less than the fracture scoreline first predetermined depth. Additionally, an anti-fracture scoreline can be positioned on the tear panel. In one embodiment, the anti-fracture score is located inside of the fracture scoreline. In an alternative embodiment, the anti-fracture score is located outside of the fracture scoreline. The anti-missile score is of a depth that is less than the anti-fracture scoreline depth. Because the depth of the anti-missile score is controlled and less than the fracture scoreline, it is highly unlikely that the scoring operation will cause displacement of the metal on the bottom or product side of the can end panel. Not only is potential damage caused by the metal forming process eliminated through the use of this anti-missile score, but the presence of metal depending below the panel so as to possibly contact an adjacent can end during stacking is eliminated as well. Additionally, alternative embodiments of the contour of the anti-missile score and its location are disclosed.

Tooling for the conversion of a can end shell into an easy open can end comprises several separate stations that are adapted for incorporation into a complete tooling set for a can end conversion press. According to this invention, one of the tooling stations is adapted to further form the panel metal so as to provide the additional anti-missile score proximate the vent region of the tear panel. The upper tooling in the conversion press can be provided with a scoring edge or knife edge to effect the desired operation.

DESCRIPTION OF THE DRAWINGS

The above as well as other features and advantages of the present invention can be appreciated through consideration of detailed description of the invention in conjunction with the several drawings in which.

DETAILED DESCRIPTION OF THE PREFERRED EMBODIMENT

Figure 1A:
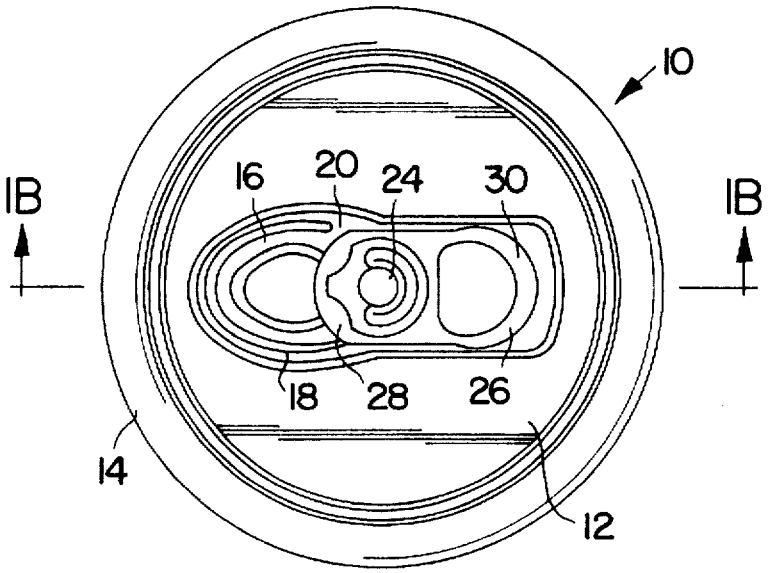
FIG. 1A is a top plan view of the improved easy-open can end incorporating the features of the present invention.
Figure 1B:
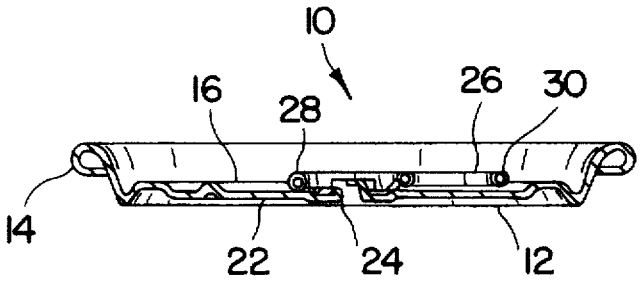
FIG. 1B is a cross sectional side view along lines 1B—1B of FIG. 1A.

A converted can end incorporating the features of the present invention is designated by reference character 10 in FIGS. 1A and 1B. Can end 10 has an end panel 12 of generally circular shape which includes a circumferentially extending raised edge 14 for attaching the can end 10 to a suitable cylindrical beverage can (not shown) or the like. In general, the can end 10 will be manufactured of a relatively ductile metal such as aluminum, but it may be made from other acceptable materials as required.

A retained tear strip 16 extends across can end 10 from a position spaced inwardly of raised edge 14 to approximately the center of can end 10. Tear strip 16 is defined by a generally V-shaped score 18 with open end 20 of the V positioned toward the center of can end 10. A score 18 is interrupted so that tear strip 16 will be captively retained on the underside or product side, 22 of can end 10 when torn open.

An integral rivet 24 is positioned adjacent open end 20 of V-shaped score 18, and a graspable ring-like pull tab 26 which may be of any desired size and configuration is secured to can end 10 by means of rivet 24. Pull tab 26 is provided with a nose portion 28 to initiate the tear along score 18 upon lifting of pull tab 26 whereupon tear strip 16 is torn open as is well known in the art. As can be seen, pull tab 26 is provided with a finger portion 30 opposite the nose portion 28. The open end 20 of the V-shaped score is below the nose 28 of the tab 26 and the adjacent the rivet 24. This portion of the can end 10 panel 12 is the vent region. It is during the initial lifting of the tab by the consumer, that this vent region is opened and internal pressure released or vented. It is to be appreciated that the industry is constantly striving to reduce the gauge of material from which can ends are manufactured. For example, most existing ends are dimensioned as 206, 204, or 202 diameter ends. A "206 diameter" end means that the end is 2 and 6/16 inches in diameter and a "202 diameter" end means that the end is 2 and 2/16 inches in diameter. As the can end has become smaller and smaller in diameter, so also has the gauge of the metal used to fabricate the end been reduced. The 206 diameter end was typically manufactured from metal having a thickness of between about 0.0096 and 0.0106 inches, while a 202 diameter end is typically manufactured from metal having a thickness of about 0.0088 inch.

Figure 2:
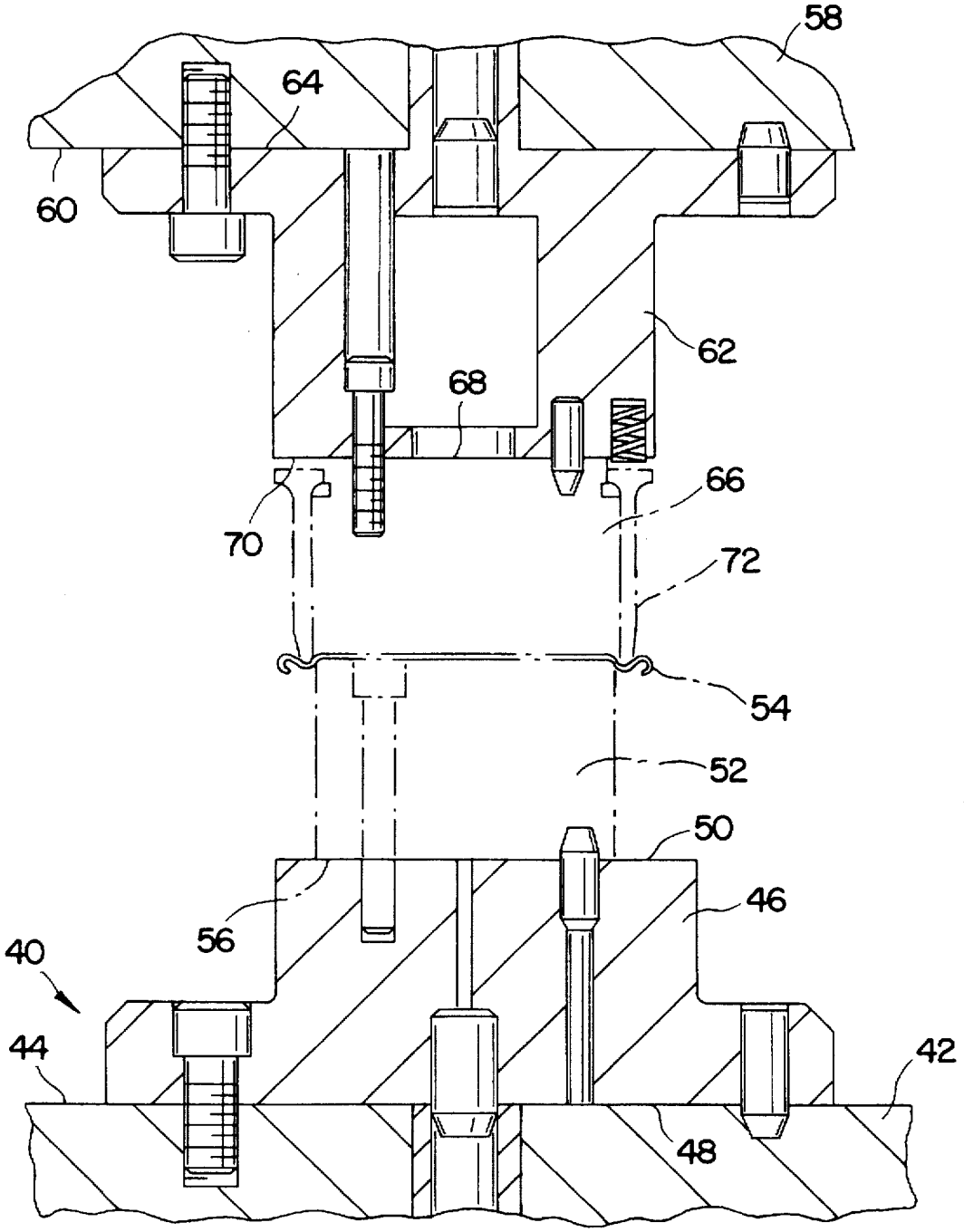
FIG. 2 is a cross sectional side view illustrating the press ram, tool support means, ram, upper and lower tool members, a support base and a stationary press bed.

The manufacture of a can end shell into an easy-open can end takes place in a conversion press, a portion of which is shown in FIG. 2. The Minster Machine Company of Minster, Ohio manufactures and sells an industrial press suitable for configuration as a can end conversion press. The conversion press 40 generally include a stationary press bed 42 including a generally planar horizontal upper surface 44. The upper surface supports a tooling base 46 which has a planar bottom surface 48 and a planar upper surface 50. Positioned upon the upper surface of tooling base is a lower tooling member 52 (shown in phantom) which make take a variety of shapes depending upon the tooling operation to be performed on the can end shell 54. However, each lower tooling member 52 has a planar bottom surface 56 which mates with the upper surface 50 of the tooling base 46 to provide secure support for the lower tooling member 52.

A vertically displaceable press ram 58 overlies press bed and includes a generally planar horizontal lower surface 60. This surface 60 of the press ram 58 supports a tool support means 62 which may take a plurality of shapes depending upon the type selected for a particular tooling operation. In general, however, the tooling support means or base 62 includes an upper planar surface 64 which provides solid mating contact with the surface 60 of the press ram 58 so that the tooling support means 62 is securely fastened to the press ram. The tool support means 62 securely supports an upper tooling member (shown in phantom) 66 having an upper planar surface 68 that is in mating contact with the lower planar surface 70 of the tool support means 62. The upper tooling member 66 can be one of many shapes and sizes depending upon the particular tooling operation to be performed. Typically, a centering ring 72 locates the can end shell 54 in each tooling station. The various types of tooling operations to be performed in succession include: bubble forming in the center of the open can lid, forming the bubble into a button; scoring an opening; paneling the can end in an area surrounding the scored opening; staking the pull tab to the can end; and stamping incise lettering upon the can end for messages such as "lift up, pull back" or "dispose of properly". U.S. Pat. No. 4,610,156, which is assigned to the assignee of the instant invention, sets forth a detailed description of the various tooling stations of a conversion press. The contents of this patent are incorporated herein by reference as if fully set forth. The can end conversion process may require from six to eight stations in which differently configured tooling carries out successive cold-working of the metal in the several steps in the conversion of a can end shell in an easy-open can end.

Figure 3A:
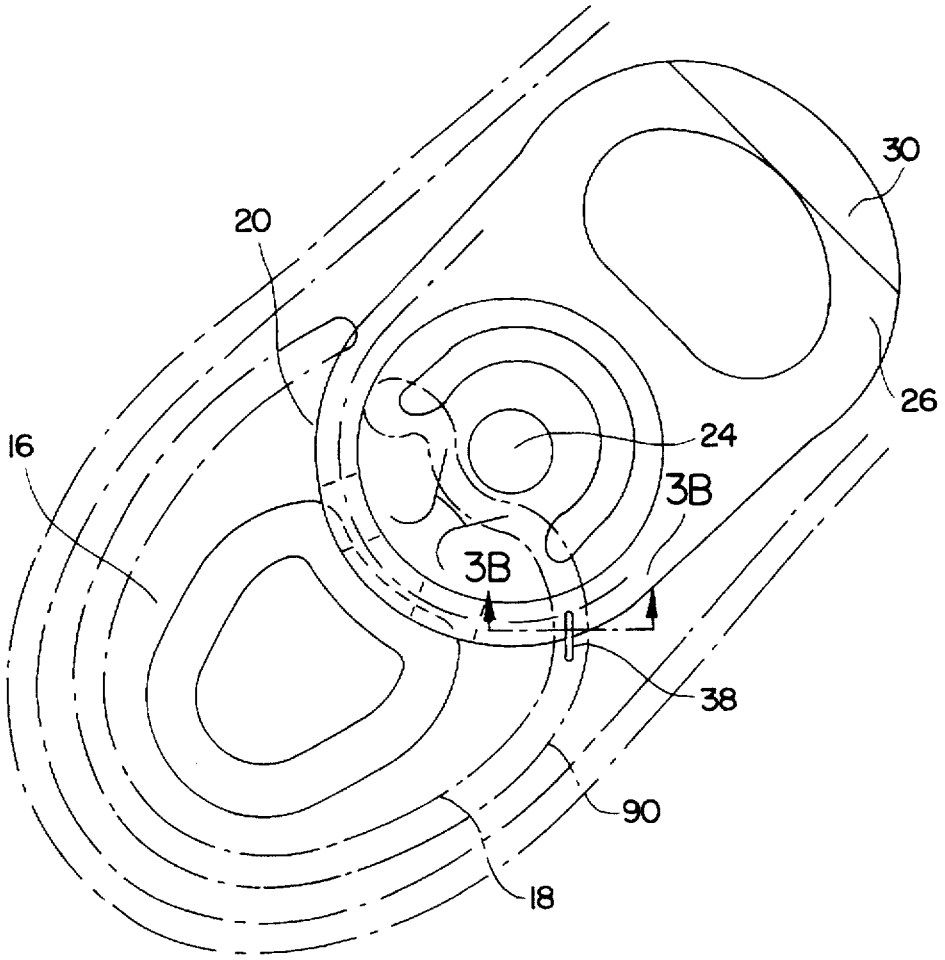
FIG. 3A is a plan view showing a detail of the easy open can end tear panel with the tab shown in phantom incorporating a first embodiment of the anti-missile score of this invention.
Figure 3B:
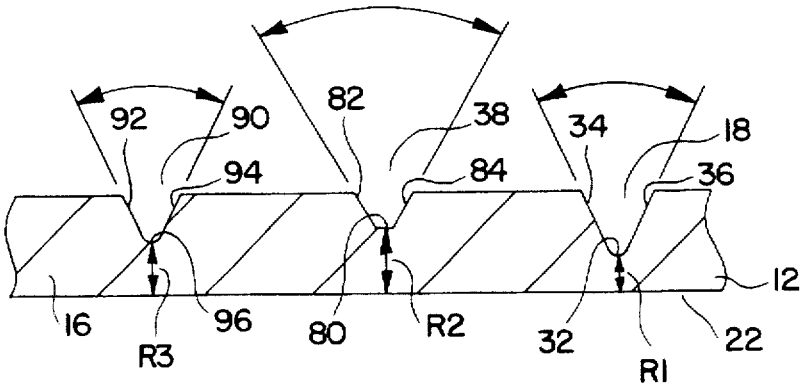
FIG. 3B is a cross-sectional detail view of the easy-open can end along section 3B—3B of FIG. 3A illustrating the main fracture score, the anti-fracture score, and the anti-missile score.

Turning now to FIGS. 3A and 3B, the main score 18 defines the outline of the tear strip 16 which is generally V-shaped. As is known in the art, the depth of the scoreline 18 may vary along the perimeter of the tear panel 16. As shown in the cross section of FIG. 3B, the main score 18 as formed is a V-shaped like cut or score disposed in the consumer side or top of the panel. Typically, such main scores are provided so as to leave a residual of metal R1, between the bottom or land 32 of the score 18 and the product side 22 of the can end. Typically, this residual can be approximately 0.0039±0.0004 inch. The land 32 of the main score 18 has a width of approximately between about 0.0010 and 0.0015 inch. The opposed inner walls 34 and 36 of the score 18 define an included angle of approximately 50°.

In a first embodiment, the anti-missile score 38 is disposed adjacent the main score 18 on the tear panel 16. The anti-missile score 38 includes a land portion 80 that has a width of approximately 0.0015±0.0005 inch. The included angle defined by the V-shaped sidewalls 82 and 84 is between approximately 55 and 65 degrees, preferably, 60°. The anti-missile score is approximately 0.0040 inches deep, as measured from the product side of the can end to the land 80. Preferably, the anti-missile score leaves a residual of metal R2, between the bottom or land 80 and the product side 22 of the can end. Preferably, the residual R2 is approximately 0.0048±0.0004 inch. As can be seen more clearly in FIG. 3*a*, this embodiment, the anti-missile score 38 has a length of between approximately 0.060 and 0.120 inch and is preferably approximately 0.100 inch long. The anti-missile score is approximately 0.025 inches from the main score 18.

In addition to the main score 18 applicant has from time to time employed an anti-fracture score designated as reference character 90. The anti-fracture score 90 is a shallow score that leaves approximately 0.0059±0.0004 inches residual on the panel. The anti-fracture score 90 generally follows the entire "U" shaped configuration of the main score 18. The anti-fracture score 90 has sidewalls 92 and 94 which define an included angle of approximately 50°. The land 96 of the anti-fracture score 90 is approximately 0.0015 inches in width. Typically, the anti-fracture score leaves a residual of metal R3, between the bottom or land 96 of the score 90 and the product side 22 of the can end. The residual R3 measures approximately 0.0059±0.0004 inch. When an anti-fracture score is used, it is disposed approximately 0.050 inches inward of the main score 18. In this embodiment, the anti-missile score 38 is disposed between the anti-fracture score and main score.

Figure 4:
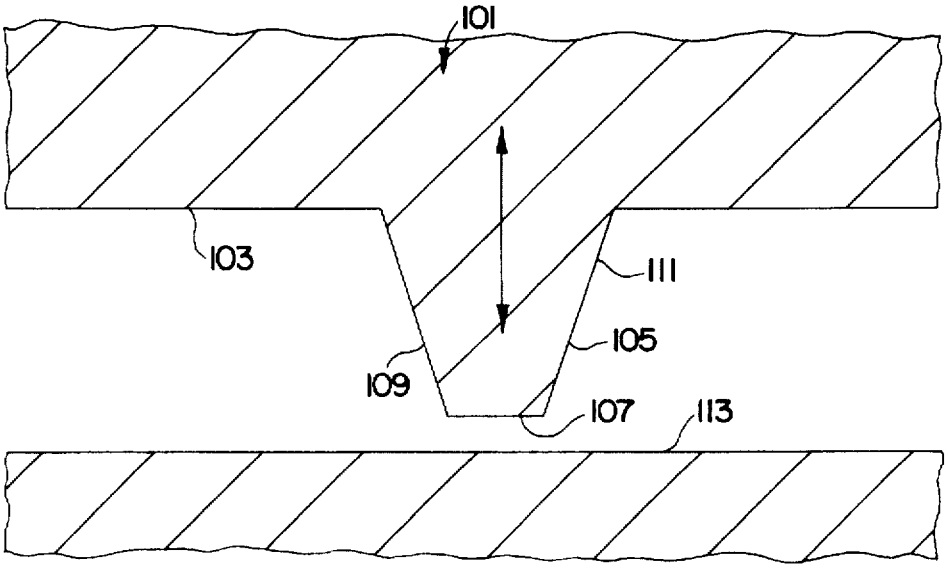
FIG. 4 an enlarged view of portions of the upper and lower tooling by which the anti-missile scoring forming operation is completed.

Turning now to FIG. 4, an example of the anti-missile scoring tooling that can be used to create the anti-missile score is shown. The scoring tooling has a body portion 101 terminating in a lower surface 103 from which the anti-missile score knife 105 projects downwardly. The score knife 105 has a knife edge 107 and a pair of lateral generally upwardly and outwardly extending sidewalls 109 and 111, respectively, at angles adapted to form the anti-missile score. It will be appreciated that by supporting the can end on a suitable anvil surface 113 which has a preferably planar upper surface and applying a compressive force to the upper surface of the can end by the score knife, a flow of metal is induced to create the profile of the anti-missile score of FIGS. 3A and 3B. A simple flat anvil surface 113 is employed. There is little, if any, showing of the anti-fracture scoreline 38 on the beverage side 22 of the panel. A conversion press may have from six to eight tooling stations that cooperate to form a can end shell to produce an easy-open can end. The anti-missile scoring tooling of this invention can be incorporated into one of the last several stations. It has been found satisfactory to form the anti-missile score in the can end in one of the final stations of the conversion sequence.

Figure 5A:
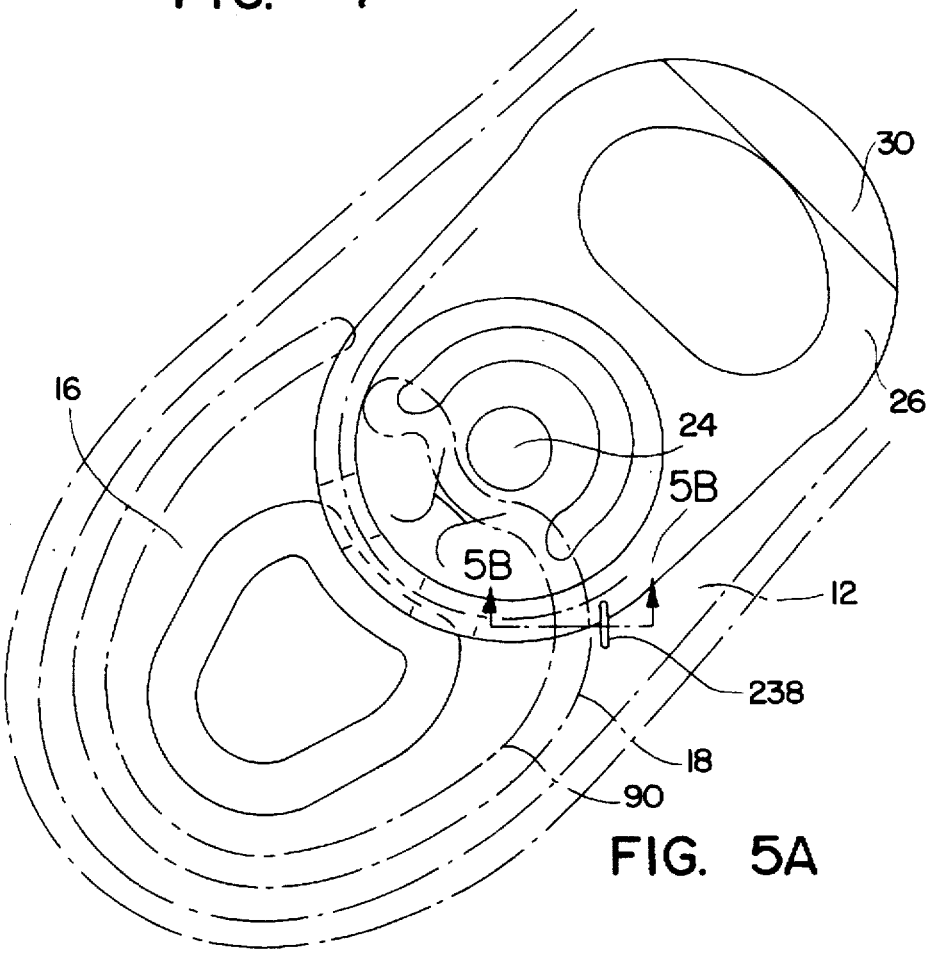
FIG. 5A is a plan view showing a detail of the easy open can end tear panel with the tab shown in phantom incorporating an alternative embodiment of the anti-missile score of this invention.
Figure 5B:
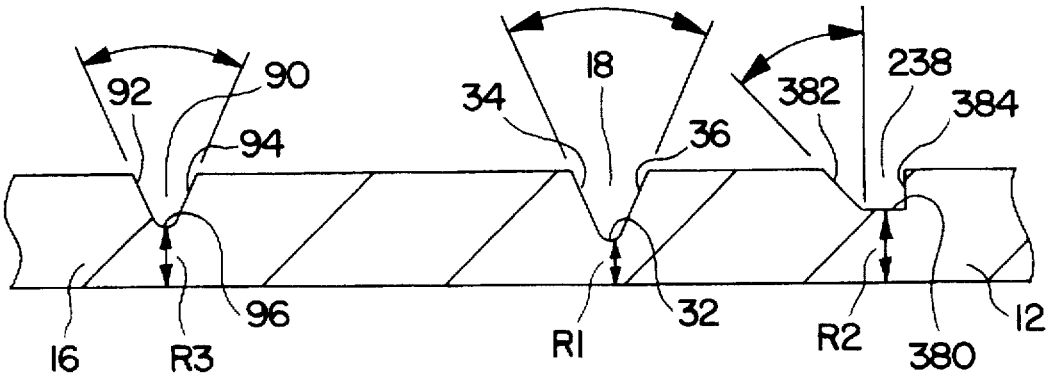
FIG. 5B is a cross-sectional detail view of the easy-open can end along section 5B—5B of FIG. 5A illustrating the main fracture score, the anti-fracture score, and an alternative embodiment of the anti-missile score.

Turning to FIGS. 5A and 5B, alternative embodiments of the anti-missile score of this invention are shown. Here, the location of the anti-missile score is changed and an alternative configuration of the anti-missile score is disclosed. As discussed above in conjunction with the embodiment of FIGS. 3A and 3B, the main score 18 defines the outline of the tear strip 16 which is generally V-shaped. The configuration and dimensions of the main score and the anti-fracture score 90 are as described above.

The anti-missile score 238 is disposed adjacent the main score 18 of the tear panel 16, opposite the side of main score 18 where the anti-fracture score 90 is located or would typically be located. The ant-missile score 238 is located on the panel portion of the can end. This position of the anti-missile score can be more clearly seen in FIG. 5B. In FIG. 5B there is shown an alternative embodiment of the anti-missile score. It is to be appreciated that the V-shaped embodiment of the anti-missile score shown in FIG. 3B can be utilized in the location shown in FIG. 5A. However, it is preferred that the anti-missile score 238 be configured according to the embodiment shown in FIG. 5B. The anti-missile score 338 includes a land portion 380 that has a width of approximately 0.0040±0.0005 inch. The included angle defined by the sidewalls 382 and 384 is approximately 45°. Preferably, the sidewall 384 is perpendicular to the end panel 12 surface. The anti-missile score is approximately 0.0040 inches deep, as measured from the product side of the can end to the land 380. Preferably, the anti-missile score leaves a residual of metal R2, between the bottom or land 380 and the product side 22 of the can end. Preferably, the residual R2 is approximately 0.0048±0.0004 inch. The anti-missile score 338 has a length of between approximately 0.060 and 0.120 inch and is preferably approximately 0.100 inch long. The anti-missile score is approximately 0.025 inches from the main score 18.

Figure 6:
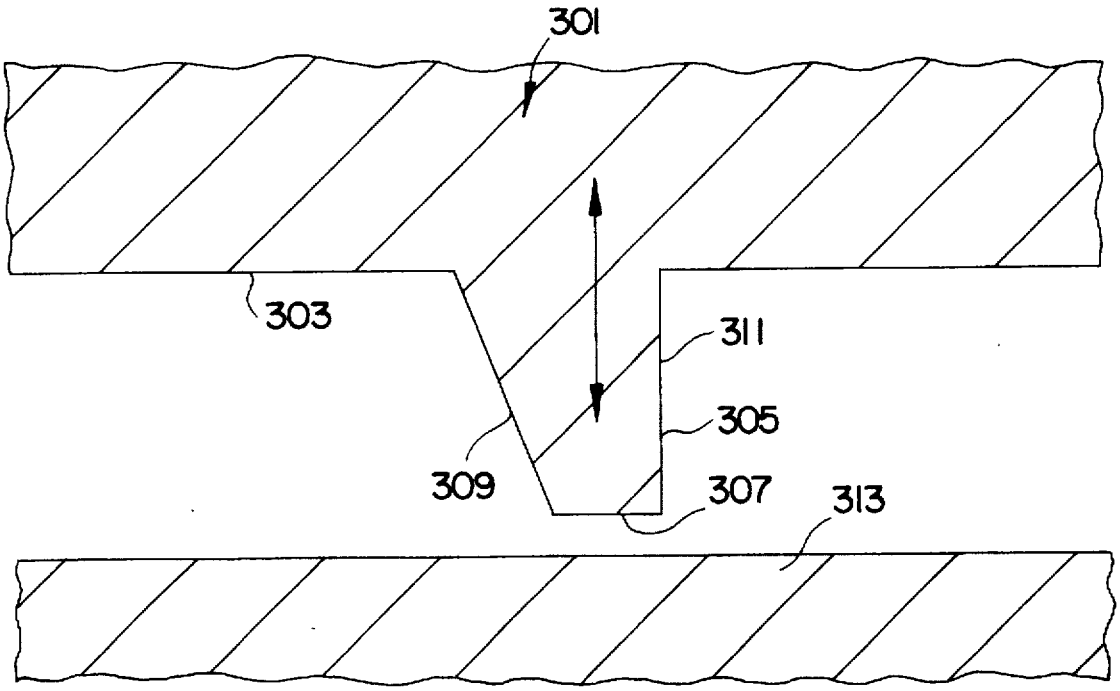
FIG. 6 is a cross-sectional view showing a detail of the easy-open can end showing an alternative embodiment of the anti-missile score.

Turning now to FIG. 6, an example of the anti-missile scoring tooling that can be used to create the alternative embodiment of the anti-missile score is shown. The scoring tooling has a body portion 301 terminating in a lower surface 303 from which the anti-missile score knife 305 projects downwardly. The score knife 305 has a knife edge 307 and a pair of lateral generally upwardly and outwardly extending sidewalls 309 and 311, respectively, at angles adapted to form the anti-missile score. It will be appreciated that by supporting the can end on a suitable anvil surface 313 which has a preferably planar upper surface and applying a compressive force to the upper surface of the can end by the score knife, a flow of metal is induced to create the profile of the anti-missile score of FIG. 5B. A conversion press may have from six to eight tooling stations that cooperate to form a can end shell to produce an easy-open can end. The anti-missile scoring tooling of this invention can be incorporated into one of the last several stations. It has been found satisfactory to form the anti-missile score in the can end in one of the final stations of the conversion sequence, typically, prior to the staking of the tab onto the rivet.

The instant invention is directed particularly to an improved method of can end formation, the tooling for this formation, and an easy-open can with the improved anti-missiling score. While the method herein described, and the forms of apparatus for carrying this method into effect, constitute preferred embodiments of this invention, it is to be understood that the invention is not limited to this precise method and forms of apparatus, and that changes may be made in either without departing from the scope of the invention which is defined in the appended claims.

What is claimed is:

1. In an easy-open end for a container, said end having a tear panel defined by a fracture score surrounding a portion of the periphery of said tear panel, said fracture score defining a region where said tear panel is to be separated from the remainder of the end to form an opening through said end, an operating tab, and an integral rivet attaching said tab to said end adjacent said fracture score on the opposite side of said fracture score from said tear panel, said fracture score including a vent region adjacent said rivet constructed and arranged to open initially at said vent region in response to lifting of said rivet by said tab; the improvement comprising:

an anti-missile score formed in said tear panel to one side of said rivet and adjacent said vent region of said fracture score and having a length extending along a least a part of said vent region and wherein the anti-missile score includes a pair of opposed side walls which define an included angle of between about 55 and 65 degrees.

2. An easy open end as defined in claim 1 wherein the fracture score is of a first predetermined depth and said anti-missile score is of a second predetermined depth that is less than said fracture score first predetermined depth.

3. An easy open end as defined in claim 1 wherein fracturing of the vent region will cause an edge of said tear panel to move temporarily underneath the end on the opposite side of the fractured score.

4. An easy open end as defined in claim 1 further including an anti-fracture score that is substantially parallel with a substantial portion of the fracture score and wherein the anti-missile score is disposed between the fracture score and the anti-fracture score.

5. An easy open end as defined in claim 1 wherein the anti-missile score is between approximately 0.060 and 0.120 inch in length.

6. An easy open end as defined in claim 5 wherein the anti-missile score is approximately 0.100 inch in length.

7. An easy open end as defined in claim 1 wherein the anti-missile score includes a pair of opposed side walls which define an included angle of between about 55 and 65 degrees.

8. An easy open end as defined in claim 7 wherein the included angle is approximately 60 degrees.

9. In an easy-open end for a container, said end having a tear panel defined by a fracture score surrounding a portion of the periphery of said tear panel, said fracture score defining a region where said tear panel is to be separated from the remainder of the end to form an opening through said end, an operating tab, and an integral rivet attaching said tab to said end adjacent said fracture score on the opposite side of said fracture score from said tear panel, said fracture score including a vent region adjacent said rivet constructed and arranged to open initially at said vent region in response to lifting of said rivet by said tab; the improvement comprising:

an anti-missile score formed in said tear panel to one side of said rivet and adjacent said vent region of said fracture score and having a length extending along a least a part of said vent region, and an anti-fracture score that is substantially parallel with a substantial portion of the fracture score and wherein the anti-missile score is disposed between the fracture score and the anti-fracture score.

10. An easy open end as defined in claim 9 further including an anti-fracture score that is substantially parallel with a substantial portion of the fracture score and wherein the anti-missile score is disposed between the fracture score and the anti-fracture score and wherein said anti-fracture score is of a first predetermined depth and the anti-missile score is of a second predetermined depth that is less than said anti-fracture score third predetermined depth.

11. An easy open end as defined in claim 9 wherein fracturing of the vent region will cause an edge of said tear panel to move temporarily underneath the end on the opposite side of the fractured score.

12. An easy open end as defined in claim 9 wherein the anti-missile score is between approximately 0.060 and 0.120 inch in length.

13. An easy open end as defined in claim 12 wherein the anti-missile score is approximately 0.100 inch in length.

14. An easy open end as defined in claim 9 wherein the fracture score includes a pair of opposed side walls which define an included angle of approximately 50 degrees.

15. An easy open end as defined in claim 9 herein the anti-fracture score defines a land having a width of approximately 0.0015 inch.

16. An easy open end as defined in claim 9 wherein the fracture score defines a land having a width of approximately 0.0010 inch.

17. An easy open end as defined in claim 9 wherein the anti-missile score includes a pair of opposed side walls which define an included angle of between about 55 and 65 degrees.

18. An easy open end as defined in claim 17 wherein the included angle is approximately 60 degrees.

* * * * *